US009373300B2

(12) United States Patent
Chang et al.

(10) Patent No.: US 9,373,300 B2
(45) Date of Patent: Jun. 21, 2016

(54) POWER MANAGEMENT METHOD AND POWER MANAGEMENT DEVICE

(71) Applicant: AU Optronics Corporation, Hsin-Chu (TW)

(72) Inventors: Chi-Wei Chang, Hsin-Chu (TW); Feng-Ming Hsu, Hsin-Chu (TW); Szu-Che Yeh, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 47 days.

(21) Appl. No.: 14/583,267

(22) Filed: Dec. 26, 2014

(65) Prior Publication Data

US 2016/0118012 A1 Apr. 28, 2016

(30) Foreign Application Priority Data

Oct. 24, 2014 (TW) ..... 103136834 A

(51) Int. Cl.
*G09G 3/36* (2006.01)

(52) U.S. Cl.
CPC ..... *G09G 3/3696* (2013.01); *G09G 2310/0224* (2013.01); *G09G 2310/08* (2013.01); *G09G 2320/0247* (2013.01); *G09G 2330/021* (2013.01)

(58) Field of Classification Search
CPC ..... G09G 2330/021; G09G 2320/0247; G09G 2310/0224; G09G 2310/08; G09G 3/3674; G09G 3/3685; G09G 3/3696
USPC ..... 345/212
See application file for complete search history.

(56) References Cited

U.S. PATENT DOCUMENTS 5,374,941 A * 12/1994 Yuki ..... G09G 3/3629 345/97
5,576,731 A * 11/1996 Whitby ..... G09G 3/3629 345/100
5,767,832 A * 6/1998 Koyama ..... G09G 3/3648 345/100
6,559,839 B1 5/2003 Ueno et al.
7,017,053 B2 3/2006 Mizuyabu et al.
8,378,951 B2 2/2013 Yen et al.
8,416,173 B2 4/2013 Ludden
8,599,177 B2 12/2013 Koyama et al.

(Continued)

FOREIGN PATENT DOCUMENTS

TW 201039310 A 11/2010
TW 201133461 A 10/2011

OTHER PUBLICATIONS

Office Action issued in corresponding Taiwan patent application on Dec. 4, 2015.

*Primary Examiner* — Tom Sheng
(74) *Attorney, Agent, or Firm* — McClure, Qualey & Rodack, LLP

(57) ABSTRACT

A power management method and a power management device for a display are disclosed, including: comparing contents in an original frame image with contents in a previous image to generate a plurality of successive second periods with first stages and second stages, shortening a plurality of time intervals in the first pulse timing distribution and outputting the first pulse timing distribution for displaying a first sub-frame image on the display during the first stage of one of the plurality of successive second periods, and shortening a plurality of time intervals in the second pulse timing distribution and outputting the second pulse timing distribution for displaying a second sub-frame image on the display during the first stage of the other one of the plurality of successive second periods; and turning off the driving circuit of the display in the second stages.

12 Claims, 8 Drawing Sheets

(56) References Cited

U.S. PATENT DOCUMENTS

| | | | | |
|---|---|---|---|---|
| 8,749,541 | B2 | 6/2014 | Kim | |
| 8,922,537 | B2 | 12/2014 | Koyama et al. | |
| 2006/0146056 | A1* | 7/2006 | Wyatt | G09G 5/006 345/501 |
| 2008/0094383 | A1* | 4/2008 | Stessen | G09G 3/3406 345/209 |
| 2010/0277463 | A1* | 11/2010 | Yen | G09G 3/20 345/213 |
| 2011/0084971 | A1 | 4/2011 | Kuo et al. | |
| 2014/0028657 | A1* | 1/2014 | Kobayashi | G09G 3/3648 345/212 |

* cited by examiner

POWER MANAGEMENT METHOD AND POWER MANAGEMENT DEVICE

CROSS-REFERENCE TO RELATED APPLICATIONS

This non-provisional application claims priority under 35 U.S.C. §119(a) on patent Application No. 103136834 filed in Taiwan, R.O.C on Oct. 24, 2014, the entire contents of which are hereby incorporated by reference.

BACKGROUND OF THE INVENTION

1. Technical Field of the Invention

The present invention relates to a power management method and a power management device, particularly to a power management method and a power management device for a display.

2. Description of the Related Art

FIG. 1 is a diagram of switching the refresh rate in the prior art. When a display is idle or in a static state and receives a static image notification, the workload can be reduced by decreasing the number of refreshing frame per second in order to decrease the refresh rate. For example, the refresh rate of the display can be reduced from 60 Hz (refresh 60 frames per second) to 5 Hz (refresh 5 frames per second). When the display receives the dynamic image notification, the refresh rate can be resumed from 5 Hz to 60 Hz. However, although reducing the refresh rate reduces the workload of the display, the amount of the saved energy is still limited because the source driver of the display is still in a standby status during the time intervals between each frame in low refresh rate.

In addition, after reducing the refresh rate, the sustaining time of a single frame is longer, and the leakage current generated by the manufacturing process of Thin-Film Transistor (TFT) leads to an inconsistent capacitance and voltage of the liquid crystal of the display, so that the flicker of display is more obvious to the user while watching.

SUMMARY OF THE INVENTION

The present invention conquers the flicker problem by interlacedly refreshing the sub-frames. In addition, by modulating the control signals in the time sequence, the present invention turns on/off the source driver of the display during the refreshing periods in order to save energy.

The present invention provides a power management method for a display, and part of a plurality of scan lines of an original frame image are classified to a first group, and the other part of the plurality of scan lines of the original frame image are classified to a second group, and the scan lines corresponding to the first group and the scan lines corresponding to the second group interlace with each other, and a first pulse timing distribution is for controlling the first group to be displayed during one of a plurality of successive first periods on a display, and a second pulse timing distribution is for controlling the second group to be displayed during another one of the plurality of successive first periods on the display. The power management method comprises comparing contents in the original frame image with contents in a previous image to generate a plurality of successive second periods, wherein the second period has a first stage and a second stage, and shortening a plurality of time intervals in the first pulse timing distribution and outputting the first pulse timing distribution for displaying a first sub-frame image on the display during the first stage of one of the plurality of successive second periods, and shortening a plurality of time intervals in the second pulse timing distribution and outputting the second pulse timing distribution for displaying a second sub-frame image on the display during the first stage of the other one of the plurality of successive second periods and turning off a driving circuit of the display during the second stage in each of the successive second periods.

In an embodiment, the present invention further compares contents in the original frame image with contents in the previous image to generate a comparison parameter, and determines a number of the plurality of successive second periods according to the comparison parameter.

In an embodiment, when the difference between the original frame image and the previous image is larger, the comparison parameter is larger and the number of the plurality of successive second periods is smaller.

In an embodiment, the present invention determines the part of the scan lines corresponding to the first group and the parts of the scan lines corresponding to the second group according to the number of the plurality of successive second periods.

In an embodiment, the present invention determines a ratio of the first stage related to the second period according to the number of the plurality of successive second periods.

The present invention provides a power management device for a display. The power management device comprises a display data receiver, a display content comparator, a data processor, a signal modulation controller, and a power manager. The display data receiver is for receiving an original frame image. The display content comparator is coupled with the display data receiver for comparing contents in the original frame image with contents in a previous image to generate a comparison parameter; The data processor is coupled with the display content comparator and the display data receiver for classifying part of a plurality of scan lines of the original frame image to a first group and classifying the other part of the plurality of scan lines of the original frame image to a second group, wherein the scan lines corresponding to the first group the scan lines corresponding to the second group interlace with each other. The signal modulation controller is coupled with the display content comparator for generating a first pulse timing distribution for controlling the first group to be displayed during one of a plurality of successive first periods on the display and generating a second pulse timing distribution for controlling the second group to be displayed during another one of the plurality of successive first periods on the display, and for generating a plurality of successive second periods according to the comparison parameter, wherein the second period has a first stage and a second stage, and shortening a plurality of time intervals in the first pulse timing distribution and outputting the first pulse timing distribution for displaying a first sub-frame image on the display during the first stage of one of the plurality of successive second periods, and shortening a plurality of time intervals in the second pulse timing distribution and outputting the second pulse timing distribution for displaying a second sub-frame image on the display during the first stage of the other one of the plurality of successive second periods. The power manager is coupled with the signal modulation controller for turning off a driving circuit of the display during the second stage in each of the successive second periods.

In summary, the present invention generates the comparison parameter K by calculating the difference of contents between the original frame image and the previous image, and determines the number the plurality of successive refreshing periods, such as the first period or the second period, and classifies the different parts of the plurality of scan lines of the original frame image to different groups, wherein the scan lines corresponding to different groups interlace with each other. The present invention further generates the plurality of successive second periods which have a first stage and a second stage according to the comparison parameter, and shortens the plurality of time intervals in the first pulse timing distribution and outputs the first pulse timing distribution related to the first period for displaying the first sub-frame image on the display during the first stage of one of the plurality of successive second periods, and shortens the plurality of time intervals in the second pulse timing distribution and outputs the second pulse timing distribution related to the first period for displaying the second sub-frame image on the display during the first stage of the other one of the plurality of successive second periods. By dynamically outputting the power control signal to turn off the driving circuit of the display during the second stage of the plurality of successive second periods, the goal of saving energy is achieved.

The contents of the present invention set forth and the embodiments hereinafter are for demonstrating and illustrating the spirit and principles of the present invention, and for providing further explanation of the claims.

BRIEF DESCRIPTION OF THE DRAWINGS

The present invention will become more fully understood from the detailed description given hereinbelow and the accompanying drawings, which are given by way of illustration only and thus are not limitative of the present invention and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
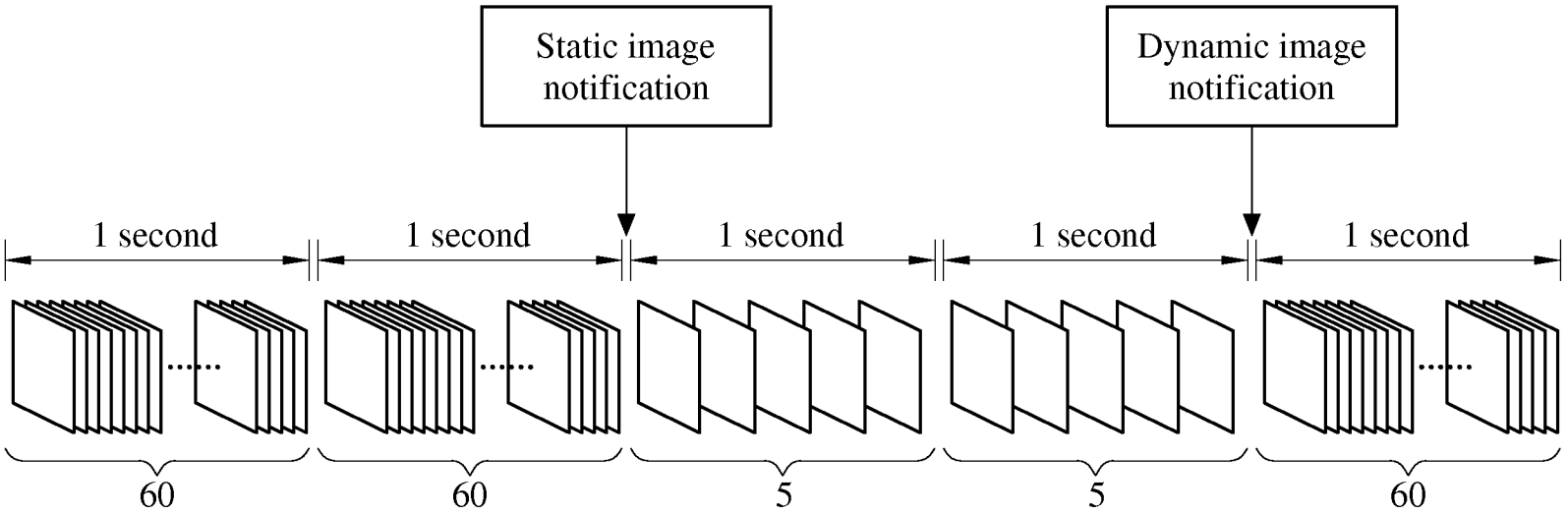
FIG. 1 is a diagram of switching the refresh rate in the prior art.
Figure 2:
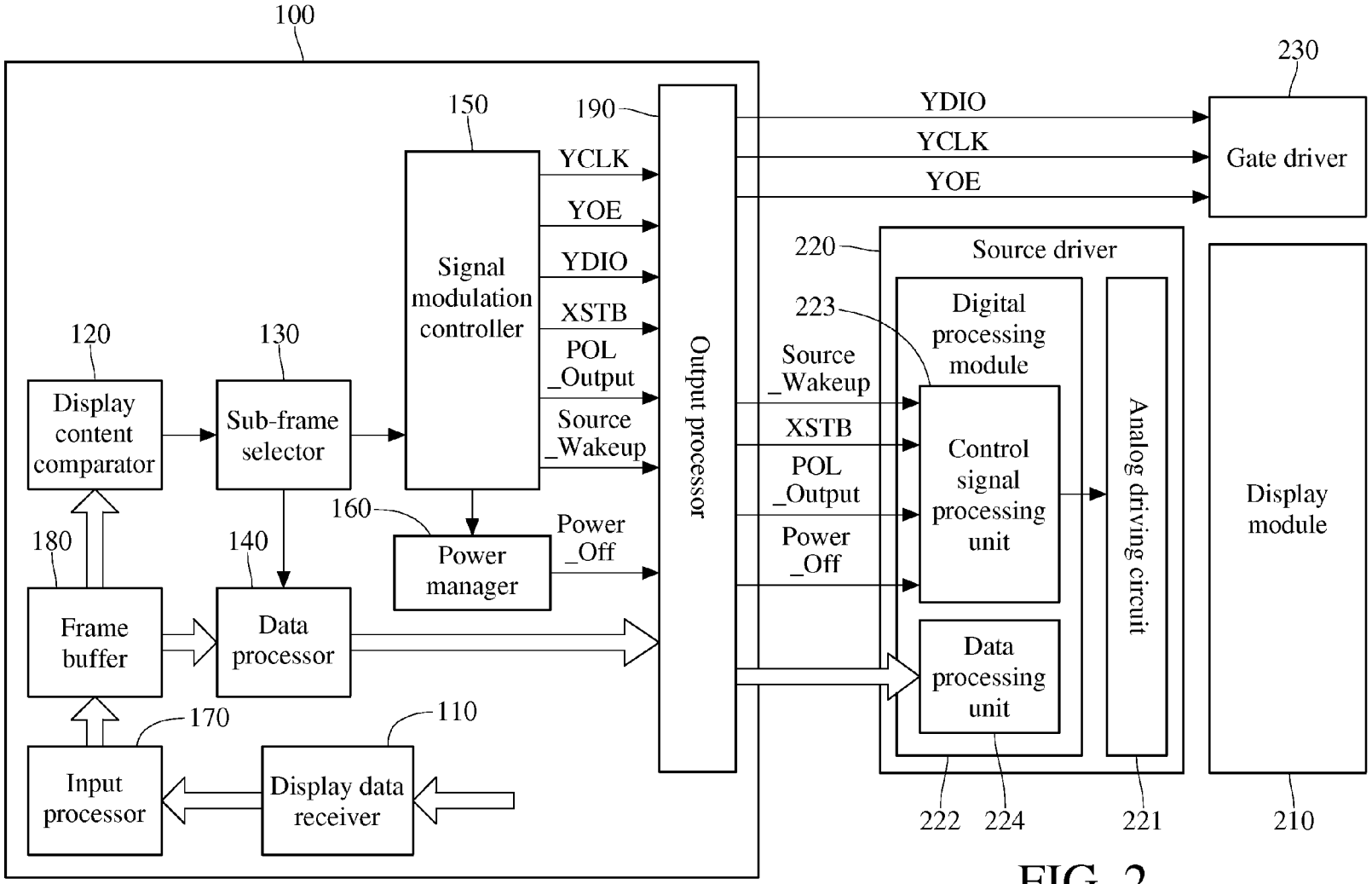
FIG. 2 is a block diagram of the power management device 100 according to an embodiment of the present invention.

FIG. 2 is a block diagram of the power management device 100 according to an embodiment of the present invention. The power management device 100 of the present invention is for a display 200. As shown in FIG. 2, the power management device 100 includes a display data receiver 110, a display content comparator 120, a sub-frame selector 130, a data processor 140, a signal modulation controller 150, a power manager 160, an input processor 170, a frame buffer 180, and an output processor 190. The display data receiver 110 has a receiver to receive the image data. The slim arrow in FIG. 2 indicates the transmission of the control signal, and the bold arrow indicates the transmission of the image data.

The display content comparator 120 is coupled with the display data receiver 110 through the input processor 170 and the frame buffer 180. The sub-frame selector 130 is coupled with the display content comparator 120. The data processor 140 is coupled with the display content comparator 120 by coupling with the sub-frame selector 130, and is coupled with the display data receiver 110 though the input processor 170 and the frame buffer 180. The signal modulation controller 150 is coupled with the display content comparator 120 by coupling with the sub-frame selector 130. The power manager 160 is coupled with the signal modulation controller 150. In an embodiment of the present invention, the display data receiver 110, the display content comparator 120, the sub-frame selector 130, the data processor 140, the signal modulation controller 150, and the power manager 160 is implemented by chips or any other processing units. The present invention does not have any limitation.

In addition, the display 200 includes a display module 210, a source driver 220, and a gate driver 230. The source driver 220 includes an analog driving circuit 221, a digital processing module 222. The digital processing module 222 includes a control signal processing unit 223 and a data processing unit 224. The details are not further described hereinafter. The functions of the display data receiver 110, the display content comparator 120, the sub-frame selector 130, the data processor 140, the signal modulation controller 150, and the power manager 160 are specifically explained in the following with other figures.

Figure 3:
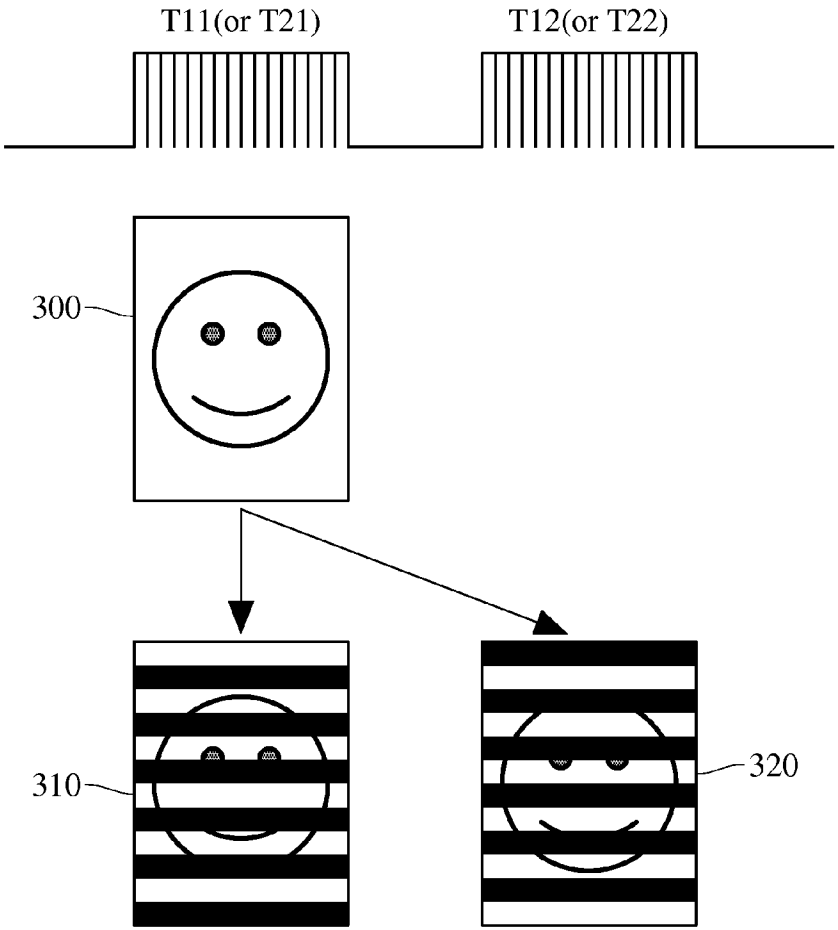
FIG. 3 is a diagram of the interlaced refreshment of a low refresh rate according to an embodiment of the present invention.
Figure 4:
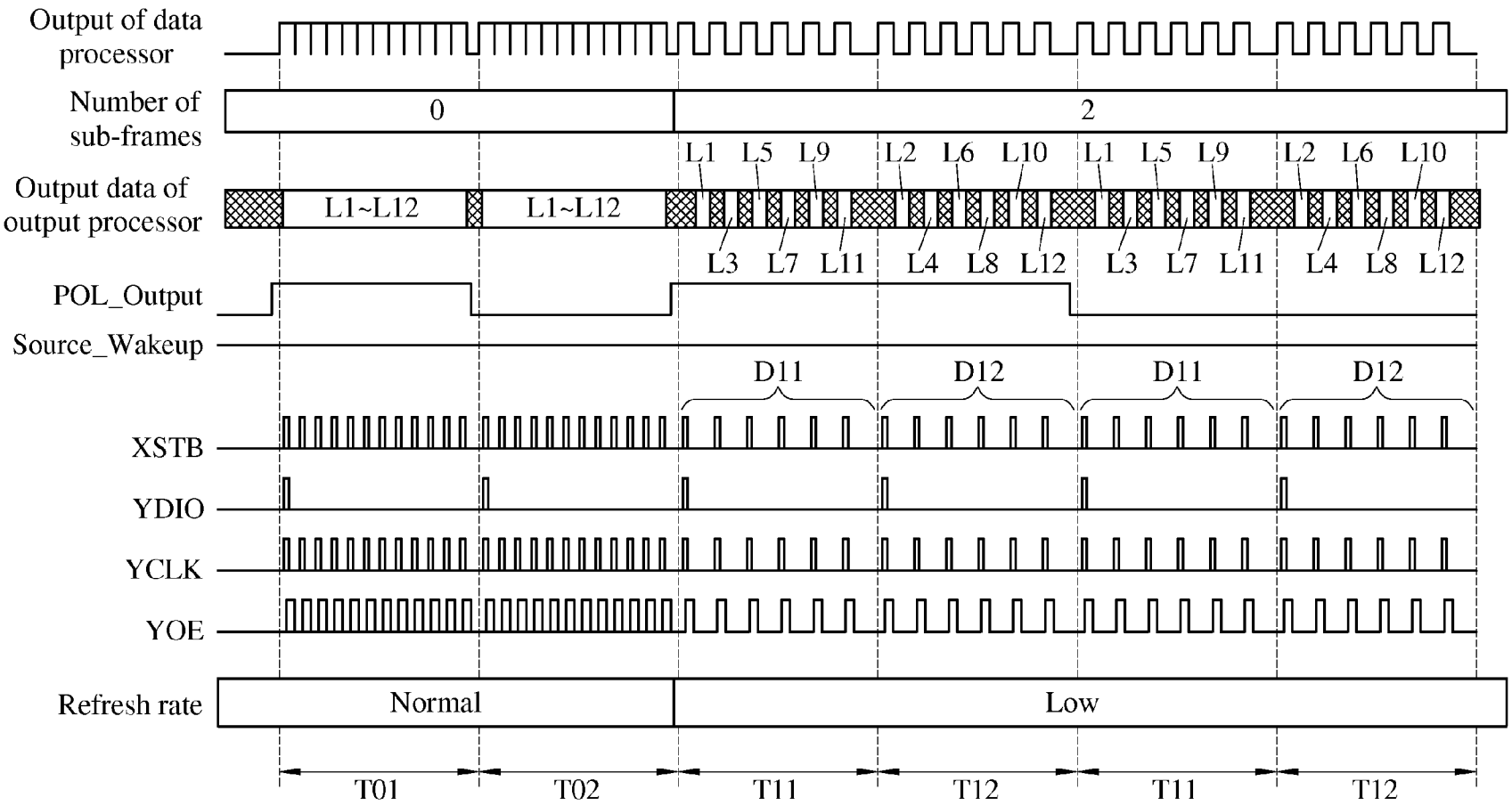
FIG. 4 is a timing diagram of the interlaced refreshment of a single low refresh rate according to an embodiment of the present invention.

FIG. 3 is a diagram of the interlaced refreshment of a low refresh rate according to an embodiment of the present invention. FIG. 4 is a timing diagram of the interlaced refreshment of a single low refresh rate according to an embodiment of the present invention. In the following explanation, please refer to FIG. 2, FIG. 3, and FIG. 4 together.

As shown in FIG. 4, when the display data receiver 110 receives an original frame image 300 and does not reduce the refresh rate, the display 200 outputs the original frame image 300 during the displaying period T01 and T02. Next, when the display 200 is going to perform the interlaced refreshment in a low refresh rate, in order to reduce the flicker of display in accordance with reducing the refresh rate, as shown in FIG. 3, the original frame image 300 is divided to a first sub-frame image 310 and a second sub-frame image 320 for interlacedly refreshing during a plurality of successive refreshing period, such as the first period T11 and T12 in FIG. 4. The original frame image 300 is corresponding to the scan lines L1~L12 of the display 200, and the different sub-frame images are corresponding to different groups of scan lines. For example, the sub-frame image 310 is corresponding to the scan lines L1, L3, L5, L7, L9, and L11, and the sub-frame image 320 is corresponding to the scan lines L2, L4, L6, L8, L10, and L12. The present invention does not have any limitation on the numbers of the scan lines.

Before dividing the original frame image 300 into a plurality of sub-frame images, the display content comparator 120 compares contents in the original frame image 300 with contents in a previous image to generate a comparison parameter. Then the sub-frame selector 130 determines a number of the plurality of sub-frame images according to the comparison parameter. In other words, the sub-frame selector 130 determines the number of the plurality of successive refreshing period, for example, the first period T11 and T12, of the plurality of sub-frame images according to the comparison parameter. As mentioned above, the data processor 140 is for classifying part of a plurality of scan lines of the original frame image to a first group, such as the scan lines L1, L3, L5, L7, L9, and L11 in FIG. 3, and classifying the other part of a plurality of scan lines of the original frame image to a second group, such as the scan lines L2, L4, L6, L8, L10, and L12 in FIG. 3, wherein the scan lines corresponding to the first group and the scan lines corresponding to the second group interlace with each other.

Next, the signal modulation controller 150 is for generating a first pulse timing distribution for controlling the first group to be displayed during one of a plurality of successive first periods on the display 200, and for generating a second pulse timing distribution for controlling the second group to be displayed during another one of the plurality of successive first periods on the display 200, wherein the first pulse timing distribution and the second pulse timing distribution are the control signal of the source driver of the display 200, e.g., XSTB, or the control signal pulses of the gate controller, e.g., YCLK and YOE, distributed in certain time intervals of the time sequence. XSTB is the control signal of the source driver for controlling the output time of the data of each scan lines, and YCLK is the reference clock of the gate controller for triggering each gate line, and YOE is the control signal for enabling each gate line of the gate controller. As shown in FIG. 4, the control signal XSTB, YCLK, and YOE respectively have the first pulse timing distribution D11, D21, and D31, and the control signal XSTB, YCLK, and YOE respectively have the second pulse timing distribution D12, D22, and D32. The first pulse timing distribution D11, D21, and D31 are corresponding to the T11 of the plurality of successive first periods and the scan lines of the first group. The second pulse timing distribution D12, D22, and D32 are corresponding to the T12 of the plurality of successive first periods and the scan lines of the second group.

As shown in FIG. 4, the data outputted from the data processor 140 is corresponding to the number of the sub-frame image determined by the sub-frame selector 130 and the number of the plurality of successive first periods. The data received by the output processor 190 is respectively outputted to a first sub-frame image 310 corresponding to the first group, i.e., L1, L3, L5, L7, L9, and L11, and a second sub-frame image 320 corresponding to the second group , i.e., L2, L4, L6, L8, L10, and L12, for the source driver 220. The output processor 190 also receives a plurality of inner control signals generated by the signal modulation controller 150 and outputs the control signal for modulating the polarity inversion (POL_Output), for waking up the source controller (Source_Wakeup), for triggering the output of each image (YDIO), and the aforementioned control signal XSTB, YCLK, and YOE, to control the source driver 220 and the gate driver 30, so that the original frame image 300 interlacedly refreshes during the first period T11 and T12. By the interlaced refreshment and the polarity inversion, the flicker problem under low refresh rate is solved.

However, in the embodiment of FIG. 4, each pulse in the first pulse timing distributions D11, D21, and D31 of the control signal XSTB, YCLK, and YOE is uniformly distributed in the first period T11, and each pulse in the second pulse timing distribution D12, D22, and D32 is uniformly distributed in the first period T12.

In addition, the definition of the time interval is the time between two pulses. The time interval between each pulse is possibly greater than the needed time for waking up the source driver 220, so the time is insufficient for turning off the source driver 220 during the time interval between each pulse to save energy.

Figure 5:
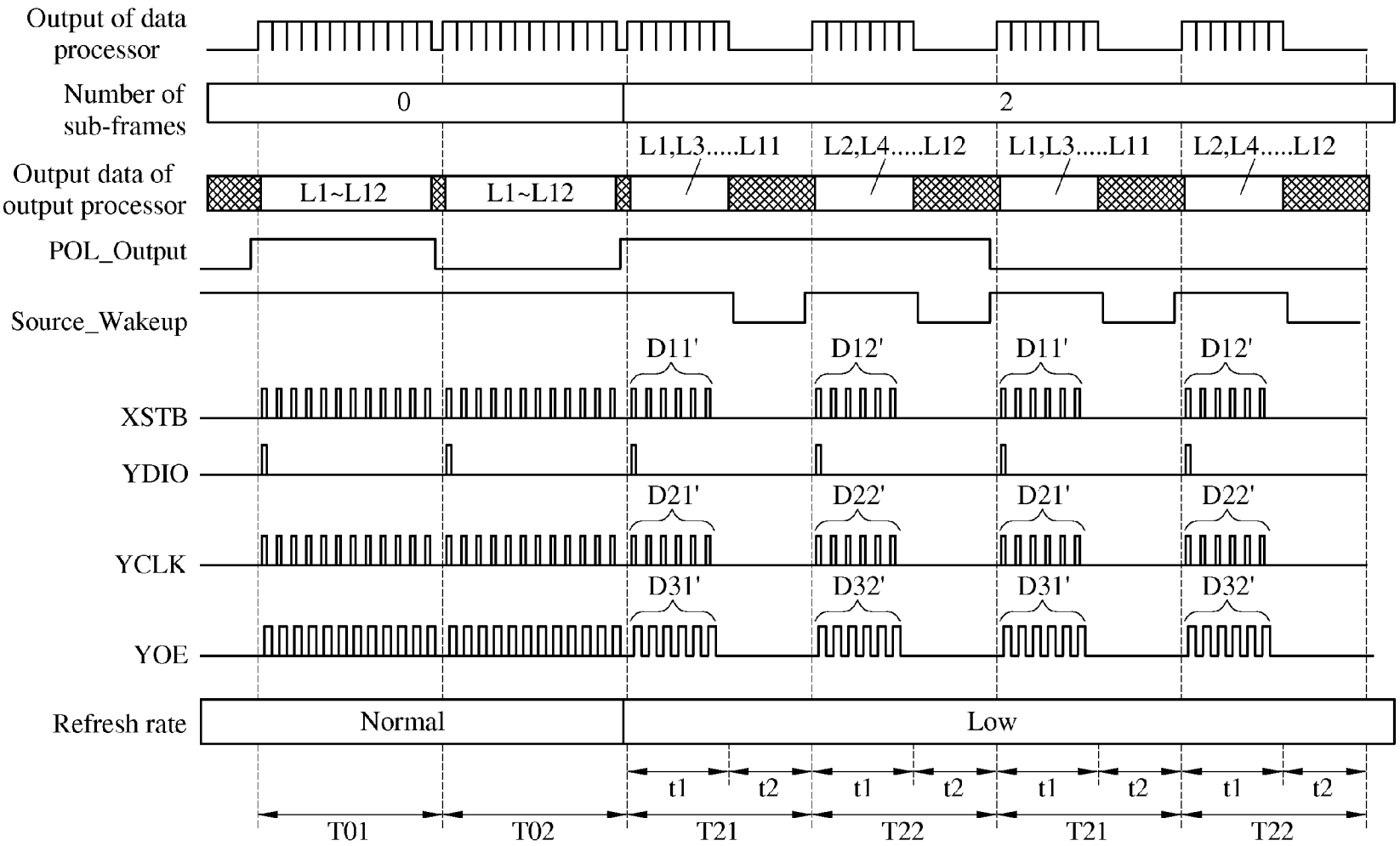
FIG. 5 is a timing diagram of the interlaced refreshment of a single low refresh rate according to another embodiment of the present invention.

FIG. 5 is a timing diagram of the interlaced refreshment of a single low refresh rate according to another embodiment of the present invention. In the following, please refer to FIG. 2, FIG. 3, FIG. 4, and FIG. 5 together. In addition, the difference between the following explanation and the previous embodiment is further described below.

In the embodiment of FIG. 5, the signal modulation controller 150 further generates a plurality of second periods according to the comparison parameter, such as the second period T21 and T22, wherein each of the second periods has a first stage t1 and a second stage t2. The signal modulation controller 150 shortens the plurality of time intervals in the first pulse timing distribution and outputs the first pulse timing distribution for displaying the first sub-frame image on the display 200 during the first stage of one of the plurality of successive second periods, such as the first stage t1 of the second period T21, and shortens the plurality of time intervals in the second pulse timing distribution and outputs the second pulse timing distribution for displaying the second sub-frame image on the display 200 during the first stage of the other one of the plurality of successive second periods, such as the first stage t1 of the second period T22. In the present invention, the first period generated by the signal modulation controller 150 stands for the refreshing period of displaying the sub-frame image on the display 200 with unshortened time intervals between the pulses of the control signal, and the second period stands for the refreshing period of displaying the sub-frame image on the display 200 with shortened time intervals between the pulses of the control signal.

Similarly, in an embodiment of the present invention, the data processor 140 further determines the part of a plurality of scan lines corresponding to the first group, such as L1, L3, L5, L7, L9, and L11, and determines the other part of the plurality of scan lines corresponding to the second group, such as L2, L4, L6, L8, L10, and L12, according to the number of the plurality of second periods. In addition, the signal modulation controller 150 further determines a ratio of the first stage t1 related to the second period t2 according to the number of the plurality of second periods.

Related to the control signal XSTB, YCLK and YOE in the first period T11 of the first pulse timing distribution D11, D21, and D31 in FIG. 4, after shortening the plurality of time intervals by the signal modulation controller 150 according to an embodiment of the present invention, the first modulated pulse timing distribution D11', D21', and D31' are formed, as shown in FIG. 5. Similarly, after shortening the plurality of time intervals in the second pulse timing distribution D12, D22, and D32 in the first period T12, the second modulated pulse timing distribution D12', D22', and D32' are formed, as shown in FIG. 5. After shortening the plurality of time intervals between the pulses of the first and the second pulse timing distribution, in other words, after squeezing forward the pulses of the first and the second pulse timing distribution in the time sequence, the correspondingly created second stage t2 in the second period T21 and T22 is larger than the needed time for waking up the source driver 220. Therefore, during the second stage t2 of the plurality of successive second period T21 and T22, in order to save energy, the power manager 160 outputs the power control signal (Power_off) to turn off the driving circuit of the display 200, such as the analog driving circuit 221 in FIG. 2. In addition, during the second stage t2 of the second period T21 and T22, the signal modulation controller 150 outputs the control signal (Source_Wakeup) in low logic level or disable level, so that the source driver 220 is forced to operate in sleep mode or rest mode.

In other words, the signal modulation controller 150 outputs the control signal Source_Wakeup (wake-up signal) in the enable level to enable the source driver 220 to receive the modulated pulse timing distribution D11', D21', and D31' for displaying the first sub-frame image on the display 200 during the first stage t1 of the second period T21, and outputs the control signal Source_Wakeup (wake-up signal) in the enable level to enable the source driver 220 to receive the modulated pulse timing distribution D12', D22', and D32' for displaying the second sub-frame image on the display 200 during the first stage t1 of the second period T22, and outputs the Source_Wakeup (wake-up signal) in the disable level to disable the source driver 220 of the display 200 during the second stage t2 of the second period T21 and T22.

In addition, in order to respectively match the data of the first sub-frame image and the second sub-frame image with the first modulated pulse timing distribution D11', D21', and D31' and the second modulated pulse timing distribution D12', D22', and D32' in the time sequence, wherein the first modulated pulse timing distribution D11', D21', and D31' and the second modulated pulse timing distribution D12', D22', and D32' generated by shortening the plurality of time intervals by the signal modulation controller 150, the data processor 140 also intensively outputs the data corresponding to the first group , i.e., scan lines L1, L3, L5, L7, L9, and L11, and the second group, i.e., scan lines L2, L4, L6, L8, L10, and L12, in the first stage t1 of the second period T21 and T22.

Figure 6:
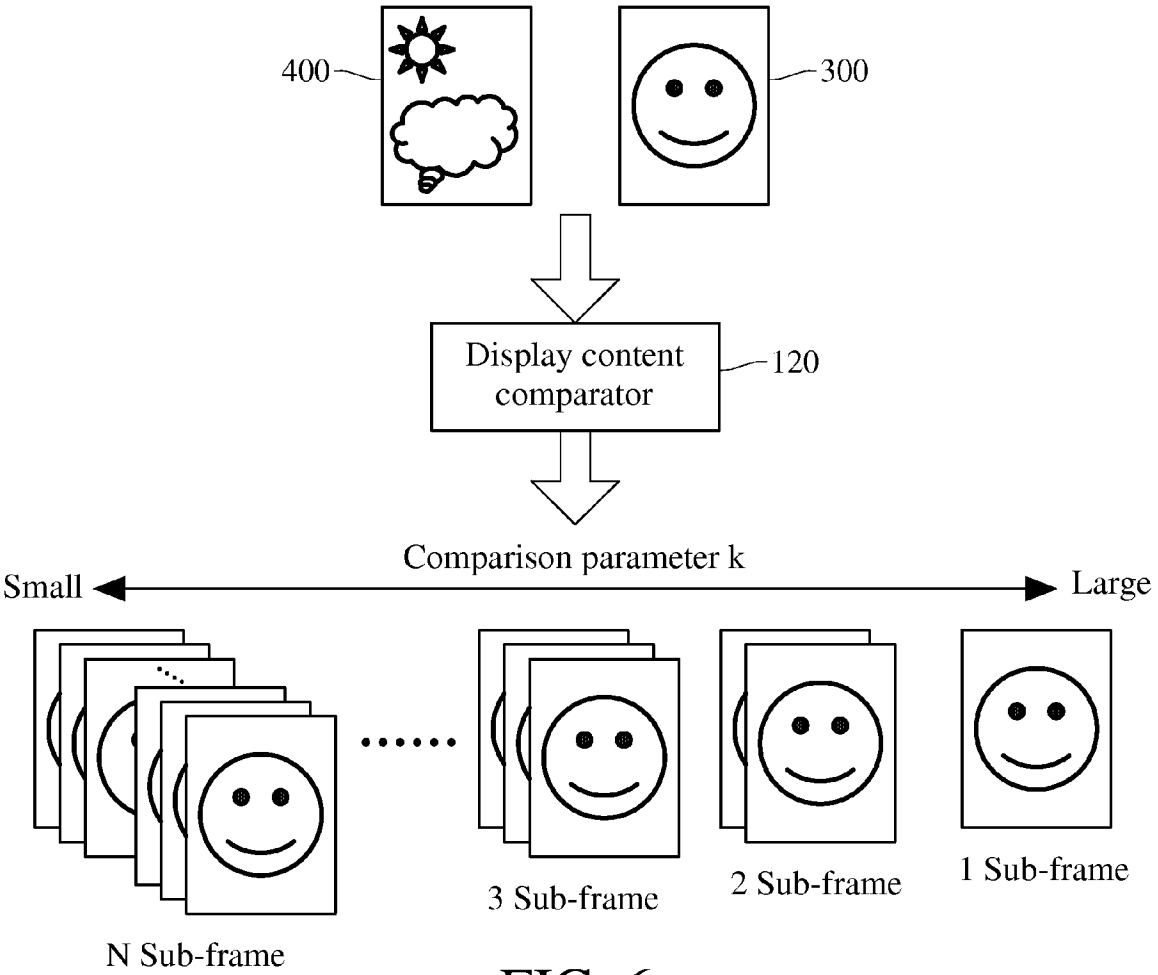
FIG. 6 is a diagram of calculating the refresh rate according to an embodiment of the present invention.

FIG. 6 is a diagram of calculating the refresh rate according to an embodiment of the present invention. As shown in FIG. 6, in an embodiment of the present invention, the display content comparator 120 calculates the difference of contents between the original frame image 300 and the previous image 400 to determine the comparison parameter K. In other words, the comparison parameter K is the difference between the original frame image 300 and the previous image 400. When the difference between the original frame image 300 and the previous image 400 is larger, the comparison parameter K is larger, and the number of the sub-frame image s generated by the sub-frame selector 130 is smaller, and the number of the plurality of refreshing periods, such as the first period or the second period, is smaller. On the contrary, when the difference between the original frame image 300 and the previous image 400 is smaller, the comparison parameter K is smaller, and the number of the sub-frame image s generated by the sub-frame selector 130 is larger, and the number of the plurality of refreshing periods, such as the first period or the second period, is larger.

Figure 7:
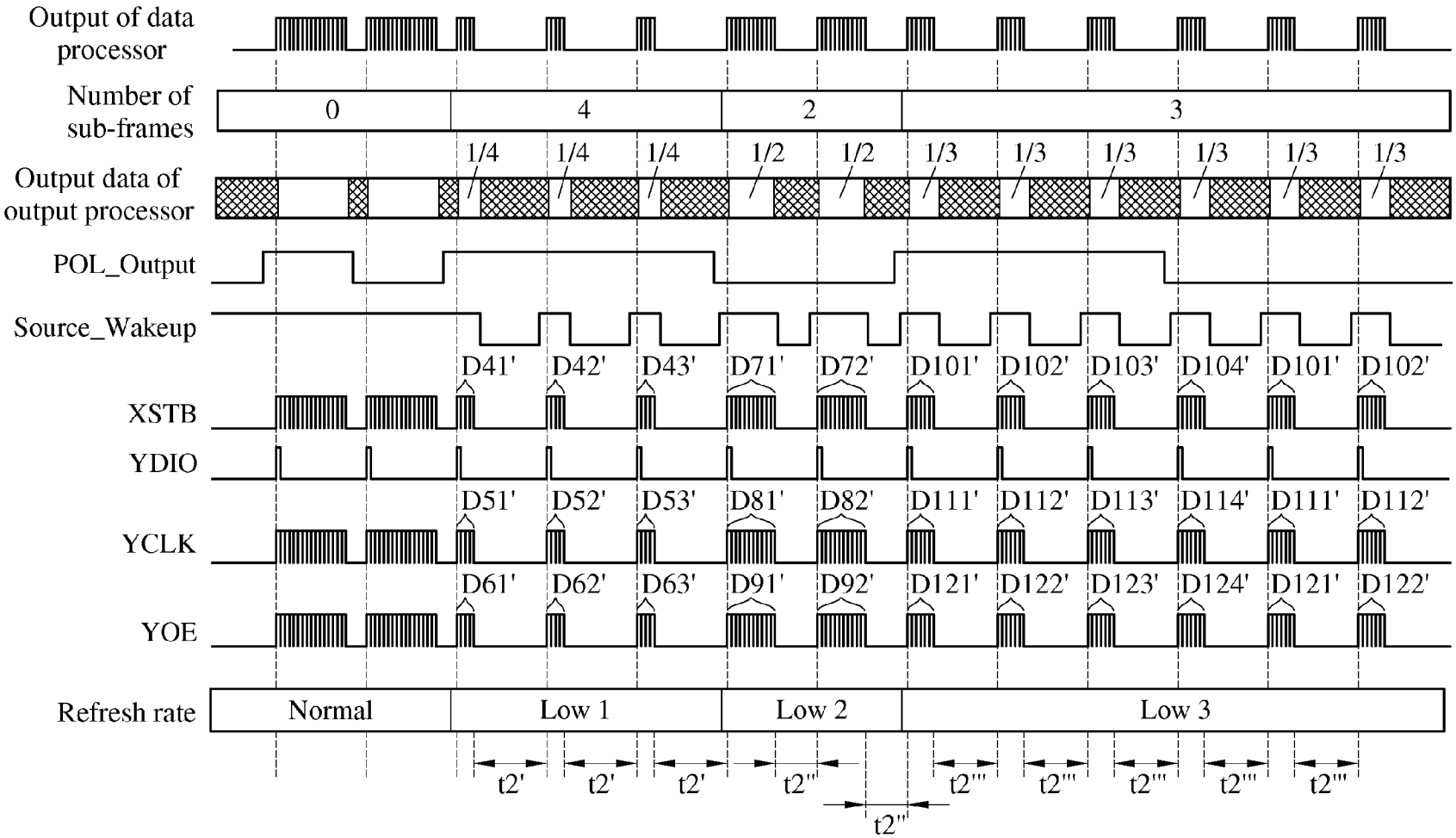
FIG. 7 is a timing diagram of the interlaced refreshment of dynamically switching the low refresh rate according to an embodiment of the present invention.

FIG. 7 is a timing diagram of the interlaced refreshment of dynamically switching the low refresh rate according to an embodiment of the present invention. In the following, please refer to FIG. 2, FIG. 3, FIG. 5, FIG. 6, and FIG. 7 together. In addition, the difference between the following explanation and the previous embodiment is further described below.

In an embodiment of the present invention, the power management device 100 further dynamically switches the low refresh rate according to the refresh rate calculation shown in FIG. 6. As shown in FIG. 7, the sub-frame selector 130 dynamically determines the number of the sub-frame image in the plurality of successive second periods according to the comparison parameter K dynamically calculated by the sub-frame selector 130. For example, when the low refresh rate of the power management device 100 is in Low 1, the number of determined sub-frame image is 4. When the low refresh rate of the power management device 100 is in Low 2, the number of determined sub-frame image is 2. When the low refresh rate of the power management device 100 is in Low 3, the number of determined sub-frame image is 3. In FIG. 7, the related art and the detail of how the signal modulation controller 150 performs the steps of shortening the plurality of time intervals to generate the modulated pulse timing distribution of the control signal XSTB, YCLK, and YOE, such as D41'~D43', D51'~D53', D61'~D63', D71'~D72', D81'~D82', D91'~D92', D101'~D104', D111'~D114', and D121'~D124', are similar to the embodiment of FIG. 5, and are not further described hereinafter.

Therefore, the different low refresh rates which are dynamically determined correspond to the second stage t2', t2", and t2'" of the second period with different lengths, and the power manager 160 outputs the power control signal (Power_off) to turn off the analog driving circuit 221 in each second stage t2', t2", and t2'" to achieve the goal of saving energy. In addition, in each second stage t2', t2", the signal modulation controller 150 also outputs the control signal (Source_Wakeup) in a low logic level to force the source driver 220 to operate in sleep mode or rest mode.

Figure 8:
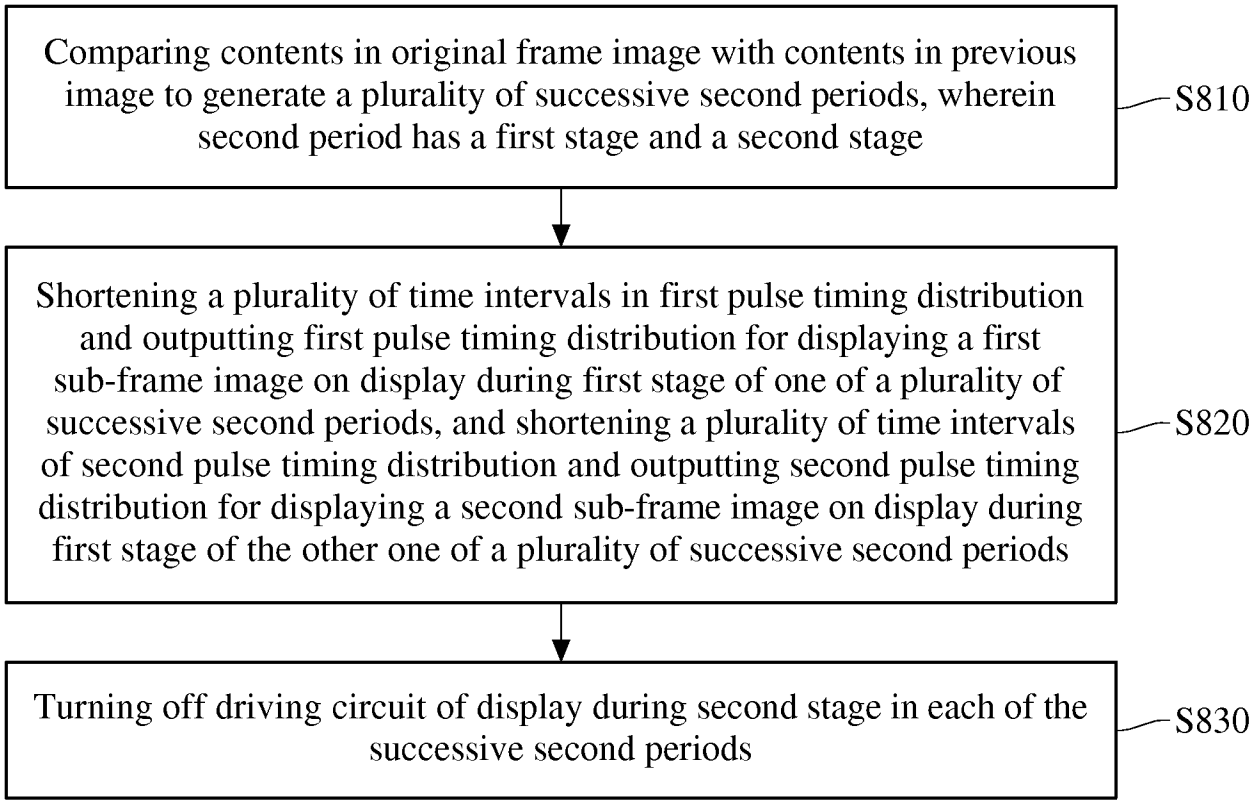
FIG. 8 is a flowchart of the power management method according to an embodiment of the present invention.

FIG. 8 is a flowchart of the power management method according to an embodiment of the present invention. As shown in FIG. 8, the power management method of the present invention is for the display 200 and comprises the steps S810~S830. In the power management method of the present invention, part of the plurality of scan lines of the original frame image are defined as the first group, and the other part of the plurality of scan lines of the original frame image are defined as the second group. The scan lines corresponding to the first group and the scan lines corresponding to the second group interlace with each other. The first pulse timing distribution is defined to control the first group for displaying on the display during one of the plurality of successive first periods, and the second pulse timing distribution is defined to control the second group for displaying on the display during one of the plurality of successive first periods.

In the step S810, the display content comparator 120 compares contents in the original frame image with contents in the previous image to generate a plurality of successive second periods, wherein each of the second periods has a first stage and a second stage. In the step S820, the signal modulation controller 150 shortens the plurality of time intervals in the first pulse timing distribution and outputs the first pulse timing distribution for displaying a first sub-frame image on the display 200 during the first stage of one of the plurality of successive second periods, and shortens the plurality of time intervals in the second pulse timing distribution and outputs the second pulse timing distribution for displaying a second sub-frame image on the display 200 during the first stage of the other one of the plurality of successive second periods. In the step S830, the power manager 160 turns off the driving circuit of the display 200 during the second stage in each of the successive second periods. The other technical details are described above and are not further described hereinafter.

In summary, according to the present invention, after the display data receiver 110 receives the original frame image, the display content comparator 120 dynamically calculates the difference of contents between the original frame image and the previous image to generate the comparison parameter K. The sub-frame selector 130 determines number the plurality of successive refreshing periods, such as the first period or the second period, or the number of the sub-frame image. The data processor 140 classifies the different parts of the plurality of scan lines of the original frame image to different groups, and the scan lines corresponding to different groups interlace with each other. The signal modulation controller 150 further generates the plurality of successive second periods which have a first stage and a second stage according to the comparison parameter, and shortens the plurality of time intervals in the first pulse timing distribution and outputs the first pulse timing distribution related to the first period for displaying a first sub-frame image on the display during the first stage of one of a plurality of successive second periods, and shortens the plurality of time intervals in the second pulse timing distribution and outputs the second pulse timing distribution related to the first period for displaying a second sub-frame image on the display during the first stage of the other one of a plurality of successive second periods. By interlacedly refreshing the first sub-frame image and the second sub-frame image, the problem of flicker under a low refresh rate is solved. In addition, the power manager 160 further dynamically outputs the power control signal to turn off the driving circuit of the display 200 for saving energy during the second stage of the plurality of successive second periods.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments of the invention. It is intended, therefore, that the specification and examples be considered as exemplary only, with a true scope and spirit of the invention being indicated by the following claims and their full scope of equivalents.

What is claimed is:

1. A power management method for a display, part of a plurality of scan lines of an original frame image classified to a first group, and the other part of the plurality of scan lines of the original frame image classified to a second group, the scan lines corresponding to the first group and the scan lines corresponding to the second group interlacing with each other, a first pulse timing distribution for controlling the first group to be displayed during one of a plurality of successive first periods on a display, a second pulse timing distribution for controlling the second group to be displayed during another one of the plurality of successive first periods on the display, the power management method comprising:

comparing contents in the original frame image with contents in a previous image to generate a plurality of successive second periods, wherein the second period has a first stage and a second stage;

shortening a plurality of time intervals in the first pulse timing distribution and outputting the first pulse timing distribution for displaying a first sub-frame image on the display during the first stage of one of the plurality of successive second periods, and shortening a plurality of time intervals in the second pulse timing distribution and outputting the second pulse timing distribution for displaying a second sub-frame image on the display during the first stage of the other one of the plurality of successive second periods; and turning off a driving circuit of the display during the second stage in each of the successive second periods.

2. The power management method of claim 1, wherein the step of comparing contents in the original frame image with contents in the previous image to generate the plurality of successive second periods further comprises:

comparing contents in the original frame image with contents in the previous image to generate a comparison parameter; and determining a number of the plurality of successive second periods according to the comparison parameter.

3. The power management method of claim 2, wherein when the difference between the original frame image and the previous image is larger, the comparison parameter is larger and the number of the plurality of successive second periods is smaller.

4. The power management method of claim 3, wherein the step of determining the number of the plurality of successive second periods according to the comparison parameter further comprises:

determining the part of the scan lines corresponding to the first group and the parts of the scan lines corresponding to the second group according to the number of the plurality of successive second periods.

5. The power management method of claim 4, wherein the step of shortening the plurality of time intervals in the first pulse timing distribution and outputting the first pulse timing distribution for displaying the first sub-frame image on the display during the first stage of one of the plurality of successive second periods, and shortening the plurality of time intervals in the second pulse timing distribution and outputting the second pulse timing distribution for displaying the second sub-frame image on the display during the first stage of the other one of the plurality of successive second periods comprises:

determining a ratio of the first stage related to the second period according to the number of the plurality of successive second periods.

6. The power management method of claim 1, further comprises:

outputting a wake-up signal in an enable level in the first stage of one of the plurality of successive second periods to enable a source driver of the display to receive the first pulse timing distribution with the shortened first stages for displaying the first sub-frame image on the display;

outputting the wake-up signal in the enable level in the first stage of the other one of the plurality of successive second periods to enable the source driver of the display to receive the first pulse timing distribution with the shortened first stages for displaying the second sub-frame image on the display; and outputting the wake-up signal in a disable level in the second stage of each of the plurality of successive second periods to disable the source driver of the display.

7. A power management device for a display, comprising:

a display data receiver for receiving an original frame image;

a display content comparator coupled with the display data receiver for comparing contents between the original frame image and a previous image to generate a comparison parameter;

a data processor coupled with the display content comparator and the display data receiver for classifying part of a plurality of scan lines of the original frame image to a first group and classifying the other part of the plurality of scan lines of the original frame image to a second group, wherein the scan lines corresponding to the first group the scan lines corresponding to the second group interlace with each other;

a signal modulation controller coupled with the display content comparator for generating a first pulse timing distribution for controlling the first group to be displayed during one of a plurality of successive first periods on the display and generating a second pulse timing distribution for controlling the second group to be displayed during another one of the plurality of successive first periods on the display, and generating a plurality of successive second periods according to the comparison parameter, wherein the second period has a first stage and a second stage, and shortening a plurality of time intervals in the first pulse timing distribution and outputting the first pulse timing distribution for displaying a first sub-frame image on the display during the first stage of one of the plurality of successive second periods, and shortening a plurality of time intervals in the second pulse timing distribution and outputting the second pulse timing distribution for displaying a second sub-frame image on the display during the first stage of the other one of the plurality of successive second periods; and a power manager coupled with the signal modulation controller for turning off a driving circuit of the display during the second stage in each of the successive second periods.

8. The power management device of claim 7, further comprising a sub-frame selector coupled with the display content comparator for determining a number of the plurality of successive second periods according to the comparison parameter.

9. The power management device of claim 8, wherein when the difference between the original frame image and the previous image is larger, the comparison parameter is larger and the number of the plurality of successive second periods is smaller.

10. The power management device of claim 9, wherein the data processor further determines the part of the scan lines corresponding to the first group and the other part of the scan lines corresponding to the second group according to the number of the plurality of successive second periods.

11. The power management device of claim 10, wherein the signal modulation controller further determines a ratio of the first stage related to the second period according to the number of the plurality of successive second periods.

12. The power management device of claim 7, wherein the signal modulation controller further outputs a wake-up signal in an enable level in the first stage of one of the plurality of successive second periods to enable a source driver of the display to receive the first pulse timing distribution with the shortened first stages for displaying the first sub-frame image on the display, and outputs the wake-up signal in the enable level in the first stage of the other one of the plurality of successive second periods to enable the source driver of the display to receive the first pulse timing distribution with the shortened first stages for displaying the second sub-frame image on the display; and outputs the wake-up signal in a disable level in the second stage of each of the plurality of successive second periods to disable the source driver of the display.

* * * * *